US007044667B2

(12) United States Patent
Tanaka et al.

(10) Patent No.: US 7,044,667 B2
(45) Date of Patent: May 16, 2006

(54) STICK-SHAPED COSMETIC MATERIAL FEEDING CONTAINER

(75) Inventors: Masahiro Tanaka, Kita-ku (JP); Yoshiaki Uehara, Adachi-ku (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 11/090,290

(22) Filed: Mar. 28, 2005

(65) Prior Publication Data

US 2005/0220527 A1 Oct. 6, 2005

(30) Foreign Application Priority Data

Mar. 31, 2004 (JP) ..... 2004-103637
Mar. 31, 2004 (JP) ..... 2004-103638
Mar. 3, 2005 (JP) ..... 2005-059495

(51) Int. Cl.
*B43K 21/08* (2006.01)

(52) U.S. Cl. ..... 401/75; 401/68; 401/116
(58) Field of Classification Search ..... 401/68–70, 401/75, 76, 116
See application file for complete search history.

(56) References Cited

U.S. PATENT DOCUMENTS 6,450,715 B1 * 9/2002 Ohba ..... 401/68
6,497,524 B1 * 12/2002 Kim ..... 401/116
6,499,897 B1 * 12/2002 Yamamoto ..... 401/68
6,764,239 B1 * 7/2004 Kim ..... 401/116

* cited by examiner

*Primary Examiner*—Tuan Nguyen
(74) *Attorney, Agent, or Firm*—Bacon & Thomas, PLLC

(57) ABSTRACT

To prevent container breakage, the stick-shaped cosmetic material feeding container comprises a screw rod (1) where a core chuck (11*a*) holding a cosmetic material (10) is provided in a leading end, and a male screw (12*a*) is formed in an outer periphery, a tubular sleeve (2) with an inner portion supporting the screw rod (1) non-rotatably and slidably in an axial direction, and a tubular main body (3) connected to the sleeve (2) from a rear side rotatably and provided with a female screw (31) engaging with the male screw (12*a*) in an inner periphery, the sleeve (2) and the main body (3) are relatively rotated to feed the cosmetic material (10), and a first rod-like member (11) and a second rod-like member (12) of the screw rod (1) are connected via a connecting means (13) allowing a synchronous rotation by a normal torque and allowing an idle running by an excessive torque.

15 Claims, 18 Drawing Sheets

STICK-SHAPED COSMETIC MATERIAL FEEDING CONTAINER

TECHNICAL FIELD

The present invention relates to a stick-shaped cosmetic material feeding container provided with a torque limiter functioning in preventing the container from being broken at a time when an excessive torque is applied to a screw rod.

BACKGROUND ART

Conventionally, as this kind of stick-shaped cosmetic material feeding container, there has been disclosed, for example, a stick-shaped cosmetic material feeding container provided with a screw rod which has a core chuck holding a stick-shaped cosmetic material and a male screw, a sleeve which has an inner portion supporting the screw rod so as to be non-rotatable and slidable in an axial direction, and a tubular main body which is connected to a rear portion of the sleeve so as to be rotatable around an axis, and has a female screw engaged with the male screw of the screw rod, and relatively rotating the sleeve and the main body so as to feed the stick-shaped cosmetic material held in the screw rod, wherein the inner portion of the main body having the female screw formed therein has a deformability which can disengage the male screw and the female screw on the basis of an excessive torque (for example, refer to Japanese Unexamined Patent Publication No. 2003-159119).

In the stick-shaped cosmetic material feeding container mentioned above, in the case that the excessive torque is applied to the screw rod, it is possible to actuate a so-called torque limiter structured such that the screw rod runs idle on the basis of disengagement of the male screw and the female screw, whereby it is possible to prevent the container from being broken.

In this case, the conventional torque limiter in this kind of stick-shaped cosmetic material feeding container is realized by employing any means for devising the structure of the engaging portion between the screw rod and the sleeve, or the engaging portion between the screw rod and the main body in one way or another, however, since no means except the means mentioned above has been proposed, it is an actual condition that a technical alternative is narrowed.

SUMMARY OF THE INVENTION

Accordingly, an object of the present invention is to provide a stick-shaped cosmetic material feeding container which can prevent the container from being broken on the basis of a distinct structure which is absolutely different from the conventional structure.

In order to achieve the object mentioned above, in accordance with the present invention, there is provided a stick-shaped cosmetic material feeding container comprising:

a screw rod in which a core chuck holding a stick-shaped cosmetic material is provided in a leading end, and a male screw is formed in an outer periphery;

a tubular sleeve which has an inner portion supporting the screw rod so as to be non-rotatable and slidable in an axial direction; and a tubular main body which is connected to the sleeve from a rear side so as to be rotatable around an axis, and in which a female screw engaging with the male screw of the screw rod is formed in an inner periphery;

the sleeve and the main body being relatively rotated so as to feed the stick-shaped cosmetic material held in the screw rod, wherein the screw rod is structured by connecting a first rod-like member having a core chuck, corresponding to a front side, and a second rod-like member with the male screw being formed, corresponding to a rear side, via a connecting means allowing a synchronous rotation on the basis of a normal torque and allowing an idle running on the basis of an excessive torque.

In this case, the male screw includes a portion of the screw rod in which a group of projections arranged intermittently in an outer peripheral surface or a group of projections arranged spirally and intermittently in the outer peripheral surface and serving the same operation as that of a screw thread are formed. Further, the female screw includes a portion of the main body in which a group of projections arranged intermittently in an inner peripheral surface or a group of projections arranged spirally and intermittently in an inside surface and serving the same operation as that of a screw thread are formed.

In accordance with the stick-shaped cosmetic material feeding container mentioned above, since the screw rod is structured by connecting the first rod-like member and the second rod-like member in a state of allowing the synchronous rotation on the basis of the normal torque and allowing the idle running on the basis of the excessive torque, it is possible to actuate the torque limiter on the basis of the distinct structure which is absolutely different from the conventional technical means obtained by devising the structure of the engaging portion between the screw rod and the sleeve, or the engaging portion between the screw rod and the main body in one way or another, whereby it is possible to prevent the container from being broken.

Therefore, in accordance with the structure mentioned above, it is possible to widen the technical alternative, that is, it is possible to contribute to making the technique plentiful.

In the technical means mentioned above, in the sight of securely avoiding a problem that the synchronous rotation is not achieved at a time of the normal torque or the idle running is not achieved at a time of the excessive torque, thereby more securely preventing the container from being broken, it is preferable that the connecting means is structured such as to connect by fitting and inserting a shaft portion which is provided in a rear end portion of the first rod-like member or a leading end portion of the second rod-like member and has a protruding line or a groove extending in an axial direction in an outer periphery, into a socket which is provided in the leading end portion of the second rod-like member or the rear end portion of the first rod-like member and has a groove or a protruding line fitted to the protruding line or the groove of the shaft portion in an inner periphery, in such a manner that the protruding line and the groove are fitted to each other.

Further, in the sight of further securely avoiding the problem that the synchronous rotation is not achieved at a time of the normal torque or the idle running is not achieved at a time of the excessive torque, thereby further more securely preventing the container from being broken, it is preferable that the connecting means is structured such that at least any one of the protruding line and the groove is constituted by an elastic body.

Further, in the sight of keeping an original function of the present stick-shaped cosmetic material feeding container of feeding the stick-shaped cosmetic material held in the screw rod while preventing a problem that the connection between the first rod-like member and the second rod-like member is cancelled by disengagement of the shaft portion fitted and inserted into the socket, it is preferable that a disengagement preventing means for preventing the fitted and inserted shaft portion from being apart from the socket is provided.

Further, in the sight of reducing a load generated in the core chuck as much as possible by arranging a rotation prevention apart from the core chuck, it is preferable that the screw rod has a rotation prevention supported so as to be non-rotatable and slidable in an axial direction by an inner portion of the sleeve in a rear side of the core chuck.

In this case, in the sight of allowing a protruding portion of a core chuck to be easily fitted to a groove within a first section in the depth side of a second section while preventing the core chuck from being struck against a step in the boundary even in the case that the step is formed in the boundary between the groove within the first section and the groove within the second section for making it possible to securely avoid the matter that the core chuck is damaged in the process of executing the work of assembling the screw rod within the sleeve, it is preferable that an inner portion of the sleeve is provided with a first section corresponding to a front side along which the core chuck slides, and a second section corresponding to a rear side along which the rotation prevention slides, the core chuck has a protruding portion protruding toward an outer side, a grove supporting the core chuck so as to be slidable in an axial direction by being fitted to the protruding portion is formed within the first section, the rotation prevention has a protruding portion protruding toward an outer side, a groove supporting the rotation prevention so as to be non-rotatable and slidable in an axial direction by being fitted to the protruding portion is formed within the second section, the rotation of the screw rod around the axis is not inhibited at a time when the screw rod is inserted and the protruding portion of the rotation prevention exists before the groove in the second section, the protruding portion of the core chuck exists before the groove in the first section at a time when the protruding portion of the rotation prevention comes to the groove in the second section, and the protruding portion of the core chuck is fitted to the grove in the first section at a time when the protruding portion of the rotation prevention exists in the middle of the groove in the second section, in the case that the sleeve is assembled by inserting the screw rod from the rear side.

In accordance with the stick-shaped cosmetic material feeding container on the basis of the present invention, it is possible to actuate the torque limiter on the basis of the distinct structure which is absolutely different from the conventional technical means, and it is possible to contribute to making the technique plentiful.

DESCRIPTION OF THE PREFERRED EMBODIMENT

A description will be in detail given first of parts relating to claims 1 to 5 in an embodiment in accordance with the present invention with reference to the accompanying FIGS. 1 to 9.

Figure 1:
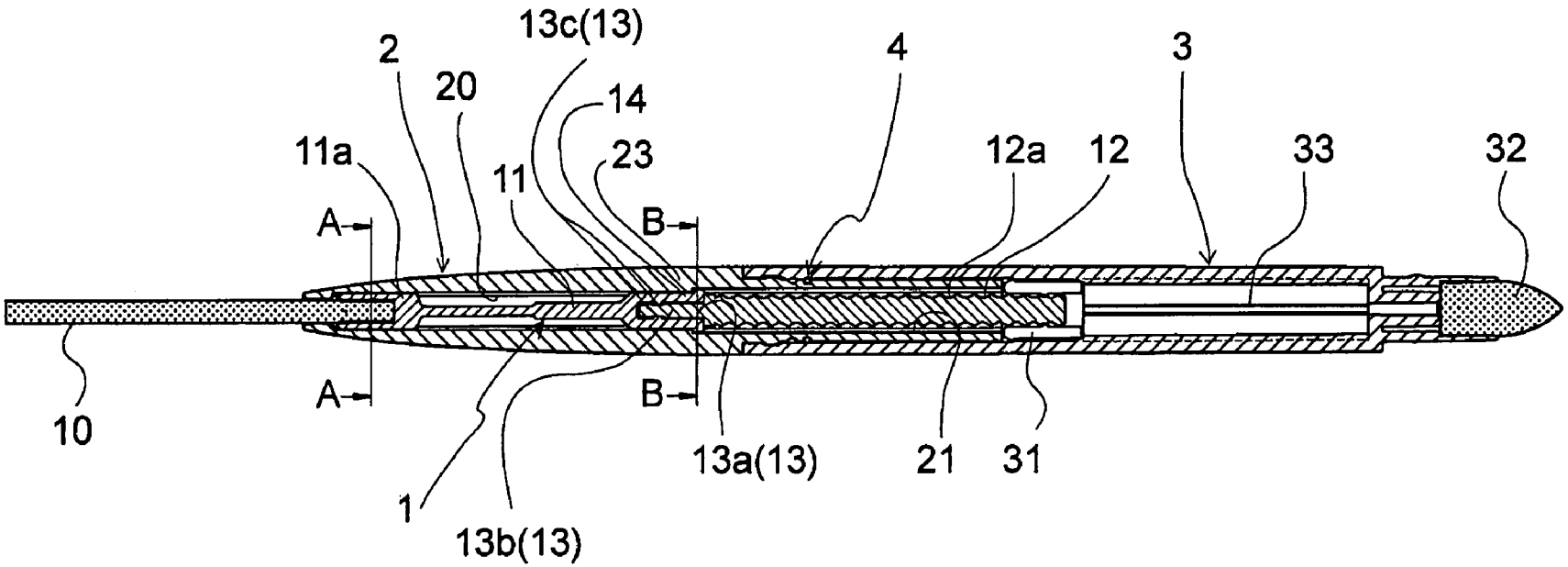
FIG. 1 is a longitudinal sectional view showing an entire structure of a stick-shaped cosmetic material feeding container in accordance with an embodiment of the present invention.
Figure 2:
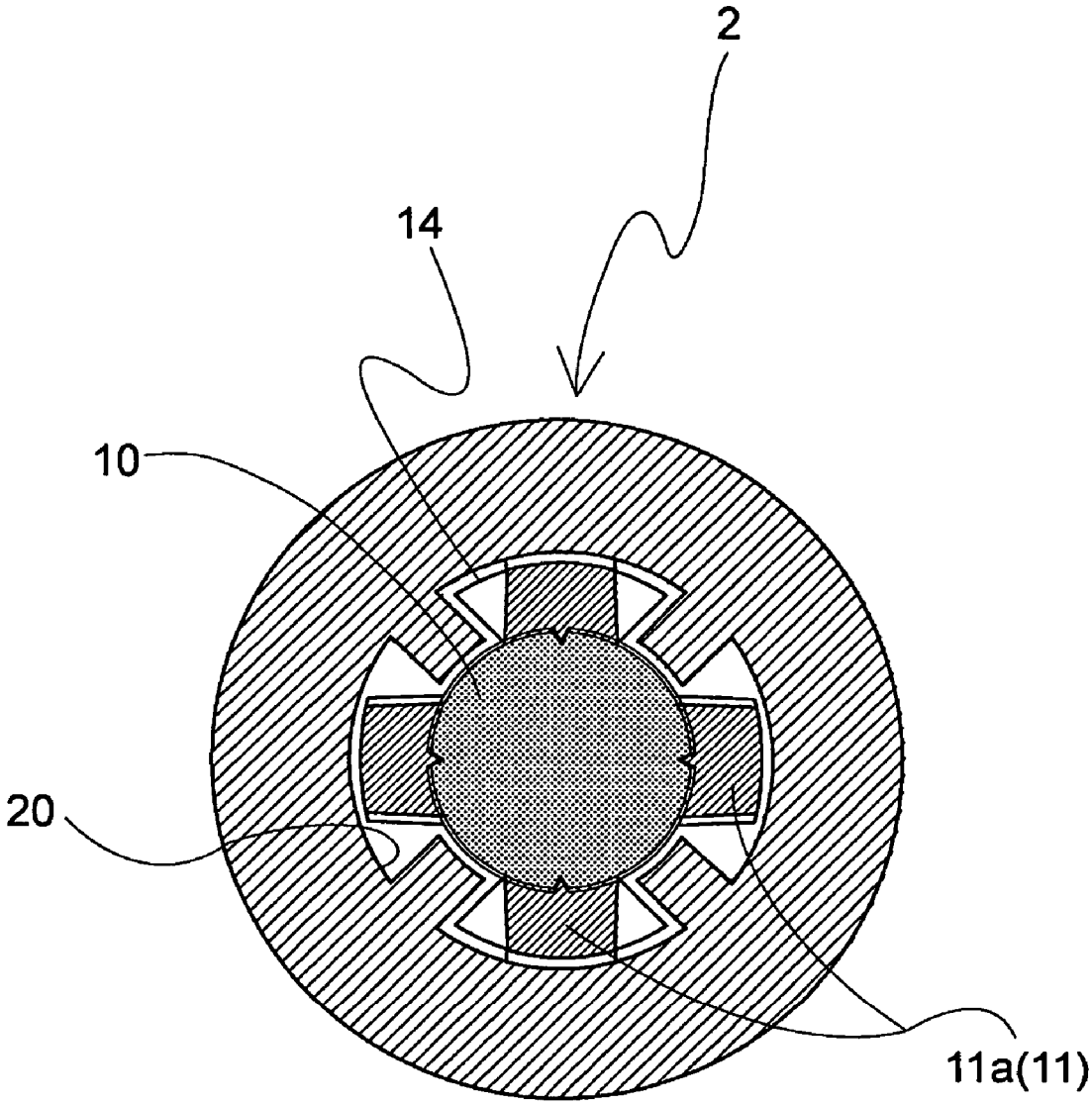
FIG. 2 is a cross sectional view along a line A—A in FIG. 1.

In the present embodiment, a stick-shaped cosmetic material feeding container is structured, for example, such as to be used for the purpose that a user appropriately feeds an eyebrow 10 corresponding to a built-in stick-shaped cosmetic material to use (refer to FIG. 1).

Further, the stick-shaped cosmetic material feeding container is structured to be provided with a screw rod 1, a tubular sleeve 2 and a tubular main body 3, as shown in FIG. 1.

A description will be further in detail given below of each of constituting elements.

(1) Screw Rod 1

A screw rod 1 is structured, as shown in FIGS. 1 to 5, such as to have a core chuck 11*a* holding the eyebrow 10 in a leading end, and have a male screw 12*a* formed in an outer periphery.

The eyebrow can be received and assembled within a sleeve 2 and a main body 3 mentioned below on the basis of the screw rod 1 mentioned above. As a result, it is possible to achieve a basic structure of a stick-shaped cosmetic material feeding container which can feed the eyebrow 10 held in the screw rod 1 by relatively rotating the sleeve 2 and the main body 3.

In the present invention, the screw rod 1 is separated into a first rod-like member 11 and a second rod-like member 12 having the same axis. Further, the first rod-like member 11 and the second rod-like member 12 are structured such as to be connected via a connecting means 13 which allows a synchronous rotation on the basis of a normal torque and allows an idle running on the basis of an excessive torque (refer to FIGS. 1 and 3 to 5).

In specific, the connecting means 13 is structured, as shown in those figures, such that the connecting means 13 is provided with a socket 13*a* which is provided in a rear end portion of the first rod-like member 11 and is open toward a rear side, and a shaft portion 13*b* which is provided in a leading end portion of the second rod-like member 12 and is to be fitted and inserted to the socket 13*a*.

Figure 3:
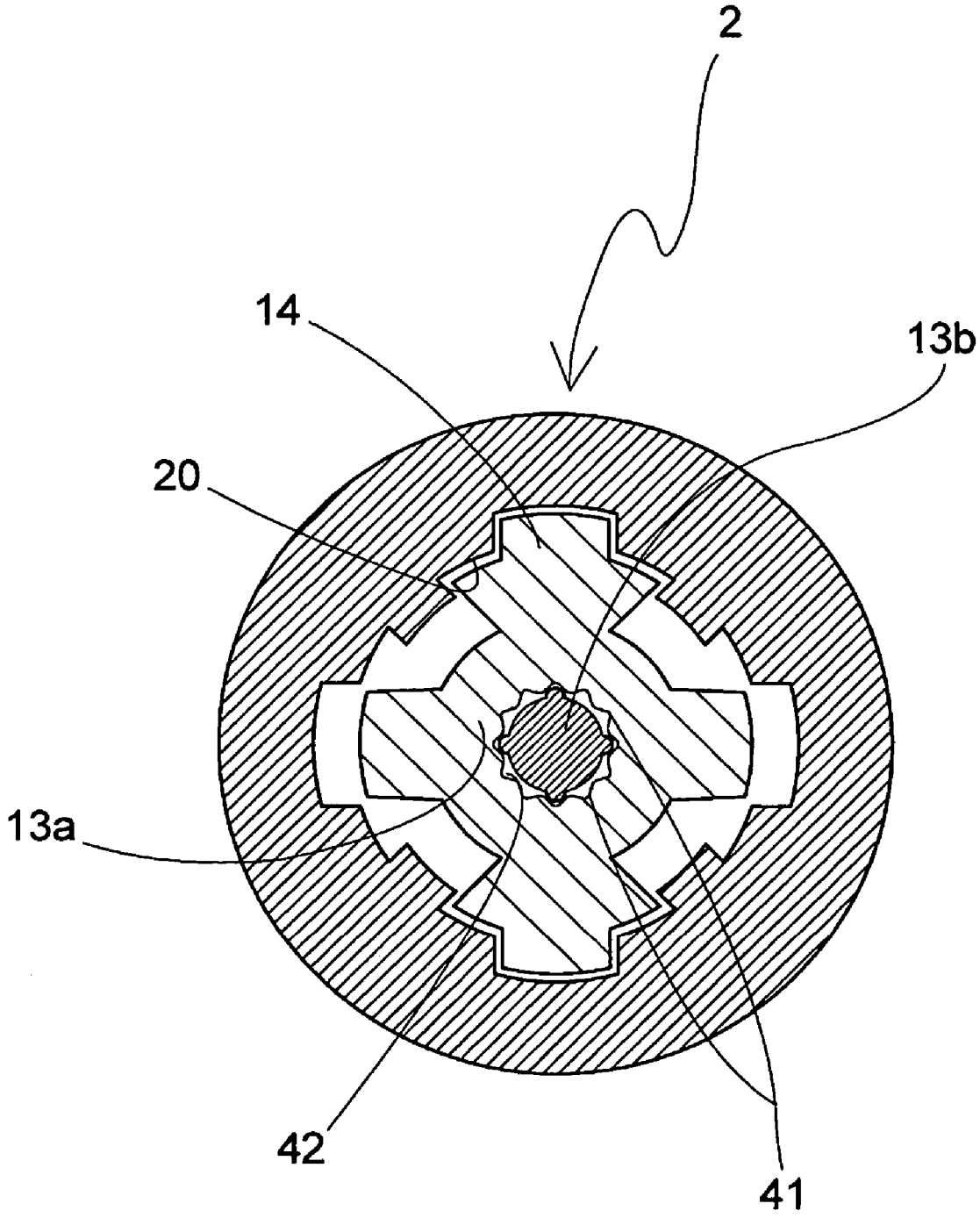
FIG. 3 is a cross sectional view along a line B—B in FIG. 1.

Further, a protruding line 41 protruding toward an outer side and extending in an axial direction is formed in the shaft portion 13*b*, as shown in FIG. 3. On the other hand, a groove 42 fitted to the protruding line 41 is formed in the socket 13*a*, as shown in the same drawing. At least one of the protruding line 41 and the groove 42 is structured as an elastic body.

In brief, the connecting means 13 connects by fitting and inserting the shaft portion 13*b* into the socket 13*a* in such a manner that the protruding line 41 and the groove 42 are fitted to each other.

As mentioned above, the screw rod 1 is required to be structured such that the first rod-like member 11 and the second rod-like member 12 are connected in a state in which the idle running can be executed by the excessive torque because it is possible to provide the stick-shaped cosmetic material feeding container in which the torque limiter can be actuated by the distinct structure which is absolutely different from the conventional one, by canceling the synchronous rotation of the first rod-like member 11 and the second rod-like member 12 at a time when the excessive torque is applied to the screw rod 1. Accordingly, as far as same function as above can be achieved, it is possible to employ the other connecting means, for example, which has neither the protruding line 41 nor the groove 42 but can allow the idle running on the basis of the excessive torque by regulating a degree of a frictional resistance applied between the socket 13*a* and the shaft portion 13*b*, in place of the connecting means 13 having the protruding line 41 and the groove 42 fitted thereto in the present invention.

In addition, the screw rod 1 is required to be structured such that the screw rod 1 is connected in the state in which the synchronous rotation can be achieved on the basis of the normal torque for the purpose of securing a basic function of the stick-shaped cosmetic material feeding container that the eyebrow 10 held in the screw rod 1 is fed by relatively rotating the sleeve 2 and the main body 3, by excluding the screw rod 1 which can not achieve the synchronous rotation on the basis of the normal torque, in the screw rod 1 which can achieve the idle running on the basis of the excessive torque. Accordingly, as far as same function as above can be achieved, it is possible to employ the other connecting means, for example, which has neither the protruding line 41 nor the groove 42 but can allow the synchronous rotation on the basis of the normal torque by regulating a degree of a frictional resistance applied between the socket 13*a* and the shaft portion 13*b*, in place of the connecting means 13 having the protruding line 41 and the groove 42 fitted thereto in the present invention.

In the present embodiment, the connecting means 13 has a disengagement preventing means 13*c* for preventing the shaft portion 13*b* fitted and inserted within the socket 13*a* from being apart from the inner side of the socket 13*a*.

It is possible to prevent the problem that the connection between the first rod-like member and the second rod-like member is cancelled by disengagement of the shaft portion fitted and inserted into the socket from being generated, on the basis of the connecting means 13, whereby it is possible to secure the original function of the present rod-like cosmetic material feeding container of feeding the stick-shaped cosmetic material held in the screw rod.

Further, the screw rod 1 is structured, as shown in FIGS. 1 to 5, such that a rotation prevention 14 is provided.

Figure 4:
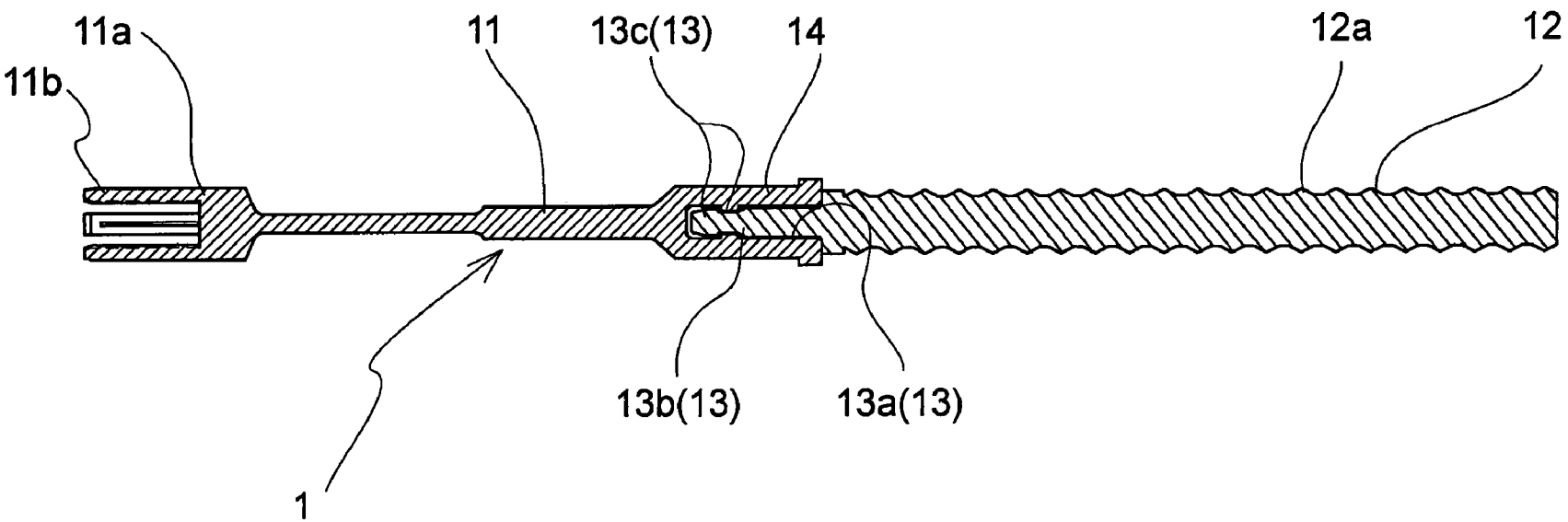
FIG. 4 is a longitudinal sectional view showing a screw rod.
Figure 5:
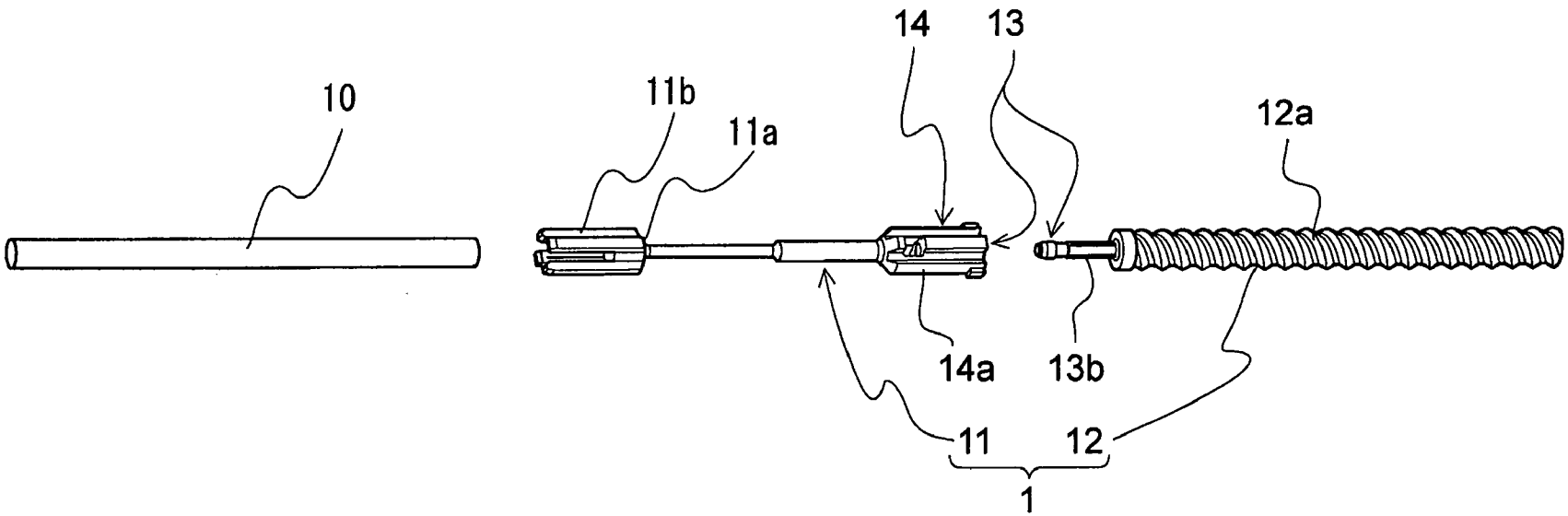
FIG. 5 is a perspective view of the same.

In specific, the rotation prevention 14 is structured, as shown in FIGS. 1, 4 and 5, the rotation prevention 14 is provided in a rear side of the core chuck 11*a* while leaving a space from the core chuck 11*a*, and regulates the maximum limit of the feeding motion of the screw rod 1, as shown in FIG. 1.

In this case, as shown in FIG. 1, the rotation prevention 14 provided in the rear side of the core chuck 11*a* while leaving a space from the core chuck 11*a* is required to be structured such as to regulate the maximum limit of the feeding motion of the screw rod 1, because it is possible to provide the stick-shaped cosmetic material feeding container in which the load generated in the core chuck can be reduced as much as possible by making the rotation prevention 14 function as a stopper member for regulating the maximum limit of the feeding motion. Accordingly, as far as same function as above can be achieved, it is possible to employ the other rotation prevention provided in adjacent to the rear side of the core chuck 11*a* in place of the rotation prevention 14 provided in the rear side of the core chuck 11*a* while leaving a space from the core chuck 11*a* in the present invention.

In this case, as shown in FIG. 1, a step 23 is formed between a front side of the sleeve 2 and a rear side of the sleeve 2 within the sleeve 2 by setting an inner diameter of the rear side of the sleeve 2 larger than that of the front side of the sleeve 2, and the forward moving limit of the feeding motion of the screw rod 1 is executed by bringing a part 14*a* of the rotation prevention 14 into contact with the step 23.

In this case, the core chuck 11*a* is structured, as shown in FIGS. 10 to 12 and 14, such as to have a protruding line 11*b* protruding toward an outer side and extending in an axial direction.

As mentioned above, the core chuck 11*a* is required to have the protruding line 11*b* protruding toward the outer side and extending in the axial direction because it is possible to provide the stick-shaped cosmetic material feeding container in which the more stable feeding motion of the eyebrow 10 can be executed by allowing the core chuck 11*a* to be supported so as to be slidable in the axial direction within the sleeve 2 in such a manner that the protruding line 11*b* of the core chuck 11*a* is fitted to the groove 21*a* in the first section 21. Accordingly, as far as same function as above can be achieved, it is possible to employ the other protruding portion, for example, a projection protruding toward an outer side, in place of the protruding line protruding toward the outer side and extending in the axial direction in the present invention.

Further, the rotation prevention 14 is structured, as shown in FIGS. 10 to 12, 16 and 18, such as to have a protruding line 14*a* protruding toward an outer side and extending in an axial direction.

As mentioned above, the rotation prevention 14 is required to have the protruding line 14*a* protruding toward the outer side and extending in the axial direction, because it is possible to provide the stick-shaped cosmetic material feeding container in which the protruding line 11*b* of the core chuck 11*a* can be easily fitted to the groove 21*a* in the first section 21 while preventing the core chuck 11*a* from being struck against the step 23 in the boundary, by allowing the protruding line 14*a* of the rotation prevention 14 to be guided so as to be fitted to the groove 22*a* in the second section 22. Accordingly, as far as same function as above can be achieved, it is possible to employ the other protruding portion, for example, a projection protruding toward an outer side, in place of the protruding line 14*a* protruding toward the outer side and extending in the axial direction in the present invention.

(2) Sleeve 2

The sleeve 2 is structured, as shown in FIGS. 1 to 3, 6 and 7, such as to be formed in a tubular shape and have an inner portion 20 supporting the screw rod 1 so as to be non-rotatable and slidable in an axial direction.

It is possible to receive and assemble the screw rod 1 in the inner portion 20 together with the main body 3 mentioned below on the basis of the sleeve 2 mentioned above. As a result, it is possible to realize the basic structure of the stick-shaped cosmetic material feeding container in which the eyebrow 10 held in the screw rod 1 can be fed by relatively rotating the sleeve 2 and the main body 3.

Figure 10:
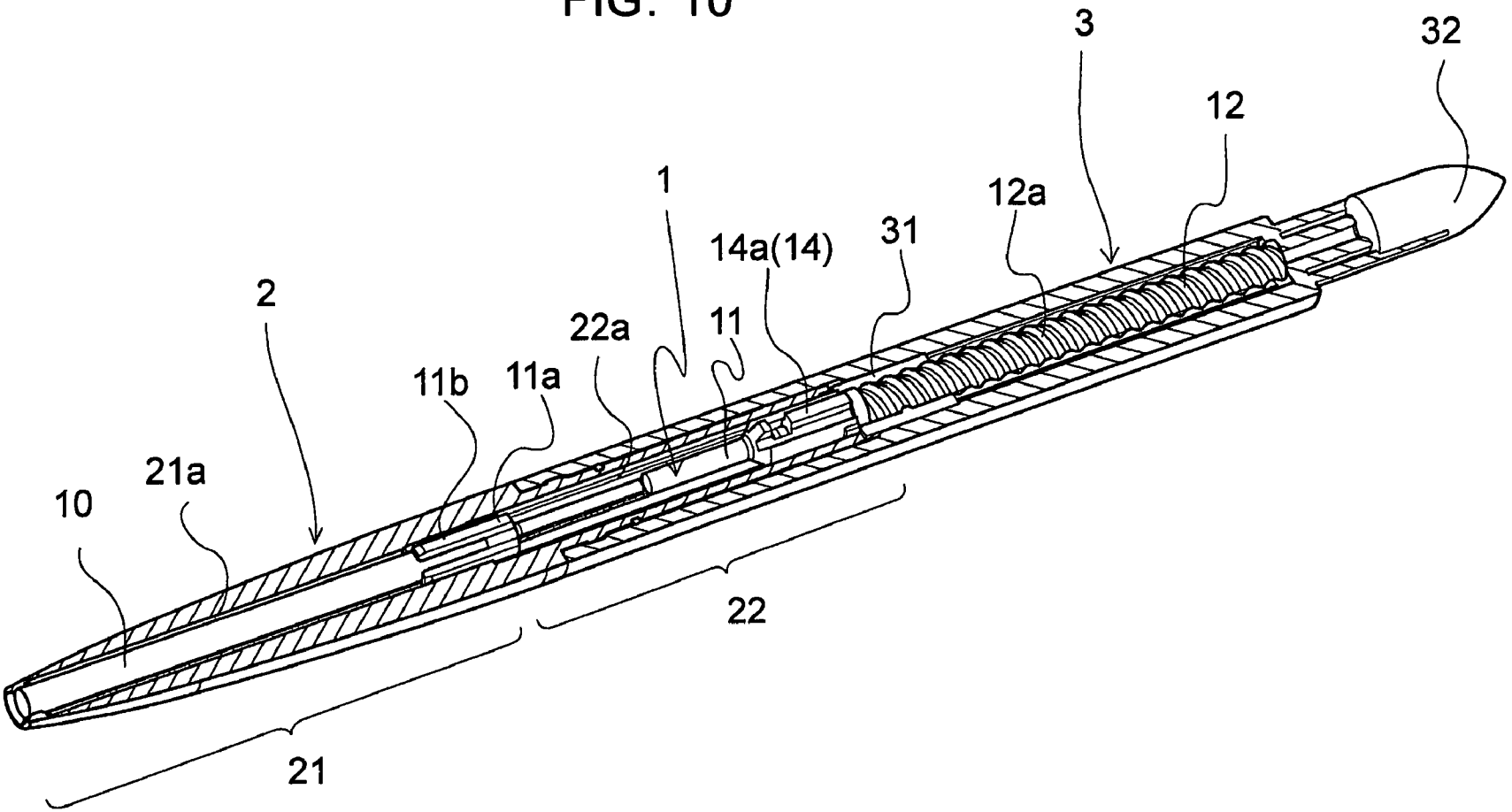
FIG. 10 is a longitudinal sectional perspective view showing an entire structure of a stick-shaped cosmetic material feeding container in accordance with an embodiment of the present invention.
Figure 11:
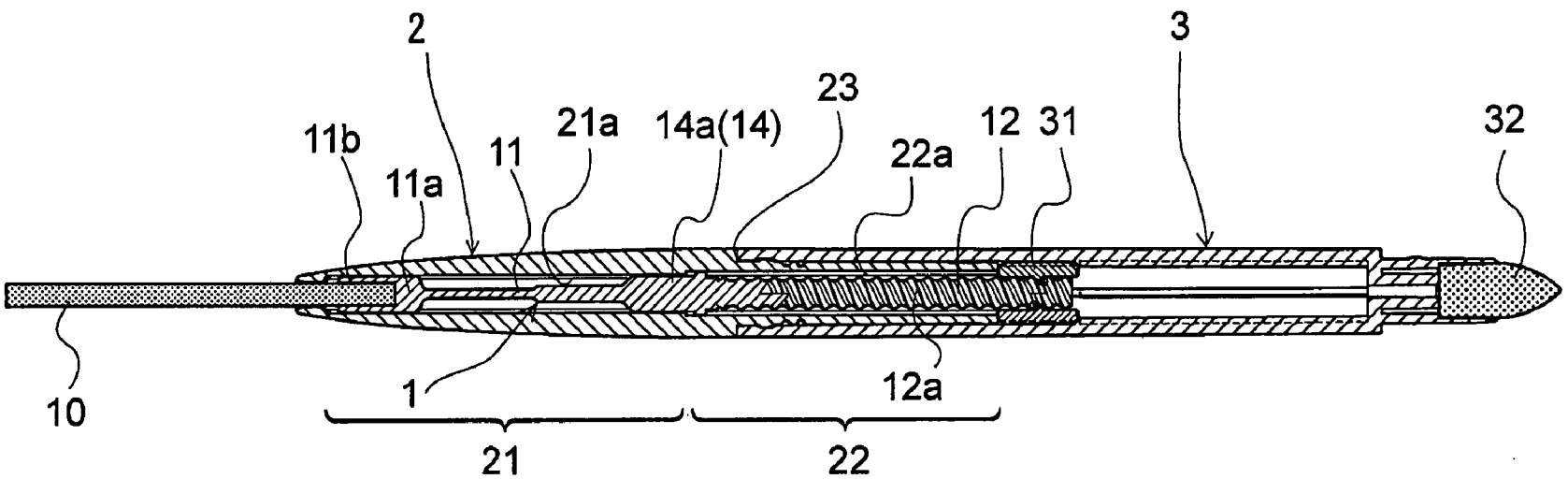
FIG. 11 is a longitudinal sectional view showing an entire structure of the stick-shaped cosmetic material feeding container.
Figure 12:
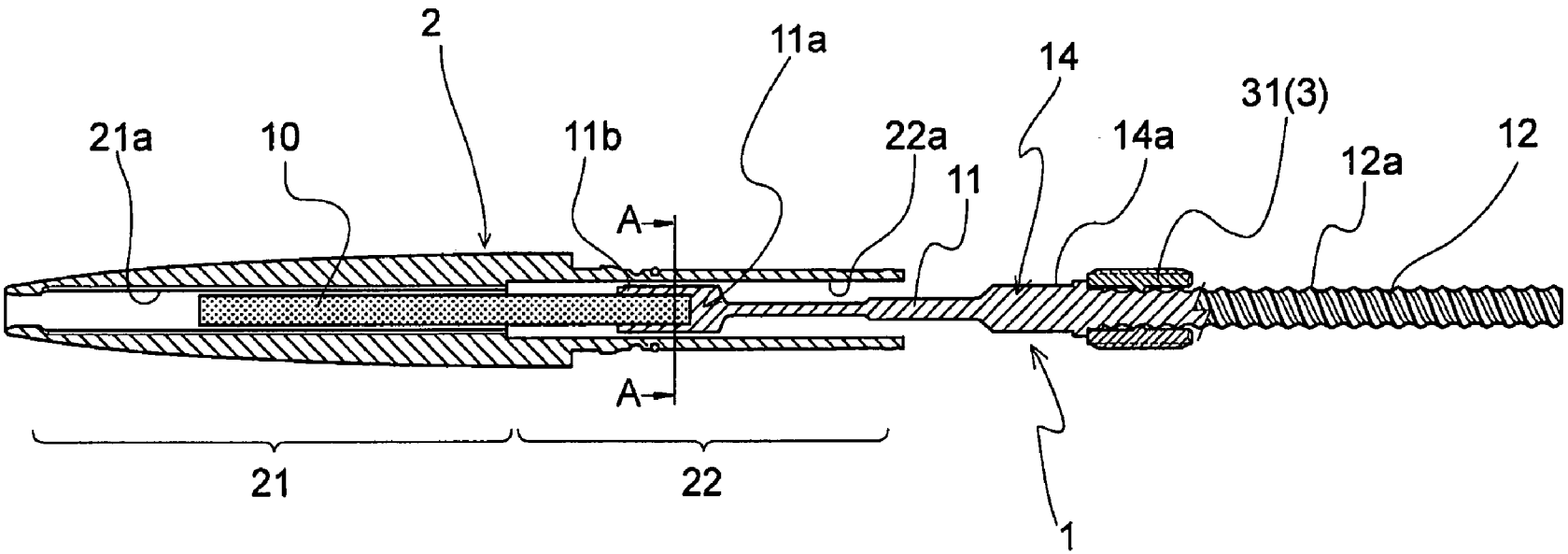
FIG. 12 is a longitudinal sectional view showing a condition of starting an assembly of the stick-shaped cosmetic material feeding container.

In specific, the sleeve 2 is structured, as shown in FIGS. 10 to 12, such that the sleeve 2 is assembled with the screw rod 1 by insertion from the rear side, and has the inner portion supporting the rotation prevention 14 provided in the rear side of the core chuck 11*a* so as to be non-rotatable and slidable in the axial direction.

It is possible to receive and assemble the screw rod 1 in the inner portion on the basis of the sleeve 2 together with the main body 3 mentioned below. As a result, it is possible to realize the basic structure of the stick-shaped cosmetic material feeding container in which the eyebrow 10 held in the screw rod 1 can be fed by relatively rotating the sleeve 2 and the main body 3.

The inner portion of the sleeve 2 in the present embodiment is structured, as shown in FIGS. 10 to 12, 13, 15 and 17, such as to be provided with a first section 21 corresponding to a front side along which the core chuck 11*a* slides, and a second section 22 corresponding to a rear side along which the rotation prevention 14 slides. The step 23 mentioned above is formed in the boundary between a groove 21*a* in the first section 21 and a groove 22*a* in the second section 22.

In this case, the groove 21*a* supporting the core chuck 11*a* so as to be slidable in the axial direction by being fitted to the protruding line 11*b* of the core chuck 11*a* is formed within the first section 21, as shown in these figures. Further, a groove 22*a* supporting the rotation prevention 14 so as to be non-rotatable and slidable in the axial direction by being fitted to the protruding groove 14*a* of the rotation prevention 14 is formed within the second section 22, as shown in these figures.

(3) Main Body 3

The main body 3 is formed in a tubular shape and is connected to the rear portion of the sleeve 2 so as to be rotatable around an axis, as shown in FIG. 1.

Figure 8:
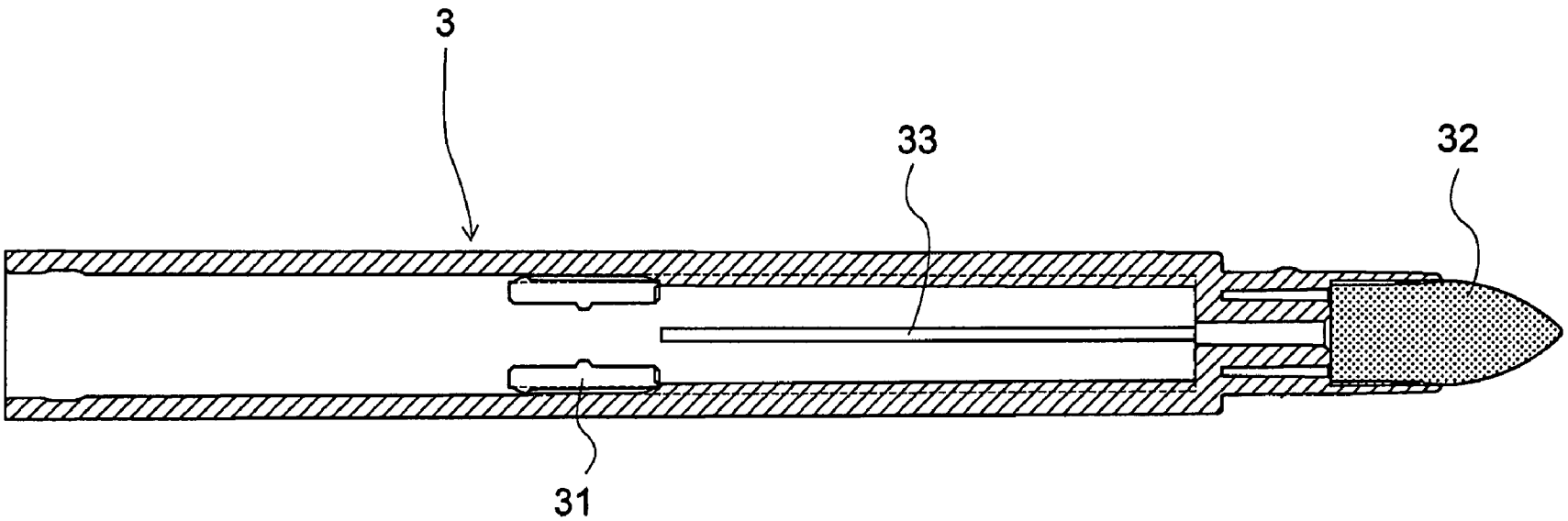
FIG. 8 is a longitudinal sectional view showing a main body.
Figure 9:
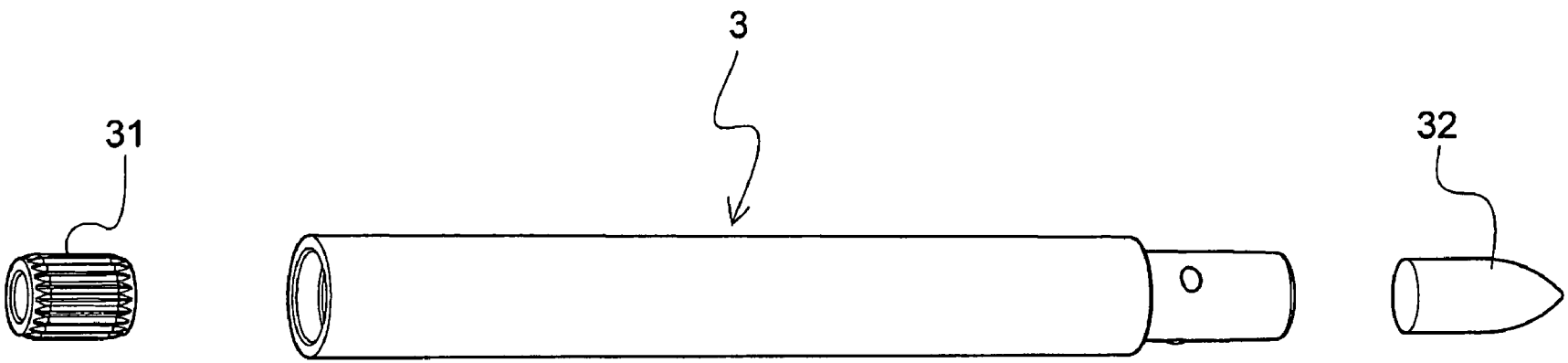
FIG. 9 is a perspective view of the same.

Further, the main body 3 is structured, as shown in FIGS. 1, 8 and 9, such as to have a female screw 31 engaging with the male screw 12*a* of the screw rod 1, and a stopper 33 corresponding to a rib protruding toward an inner side from an inner portion in a rear side of the female screw 31 and extending in an axial direction.

In this case, the female screw 31 is specified by non-rotatably attaching a tubular member in which the female screw is formed in an inner portion to the main body and fixing the tubular member while pinching between the rear end of the sleeve 2 and the stopper 33.

It is possible to receive and assemble the screw rod 1 in the inner portion 20 together with the sleeve 2, on the basis of the main body 3. As a result, it is possible to realize the basic structure of the stick-shaped cosmetic material feeding container in which the eyebrow 10 held in the screw rod 1 can be fed by relatively rotating the sleeve 2 and the main body 3.

Figure 6:
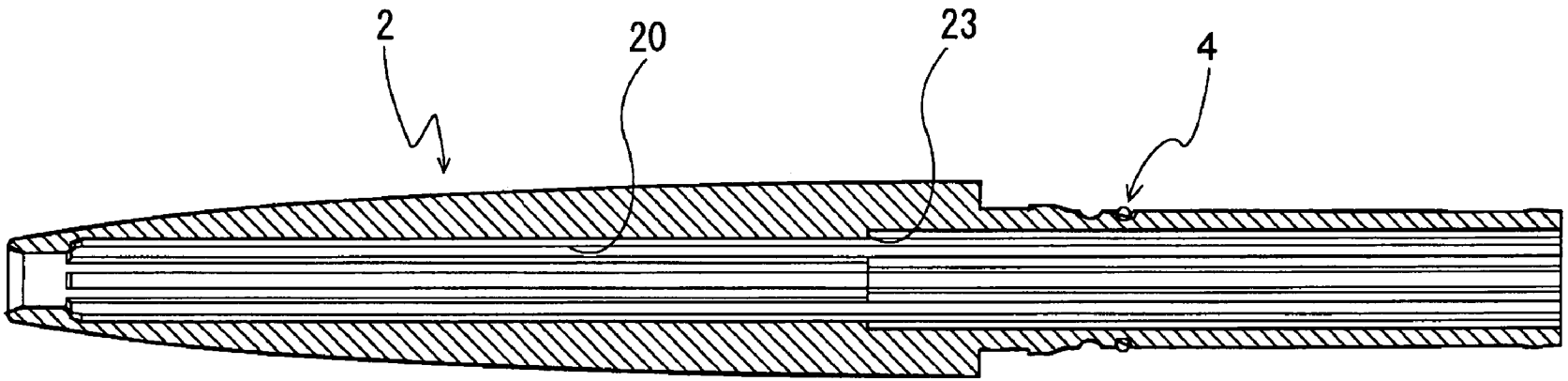
FIG. 6 is a longitudinal sectional view showing a sleeve.
Figure 7:
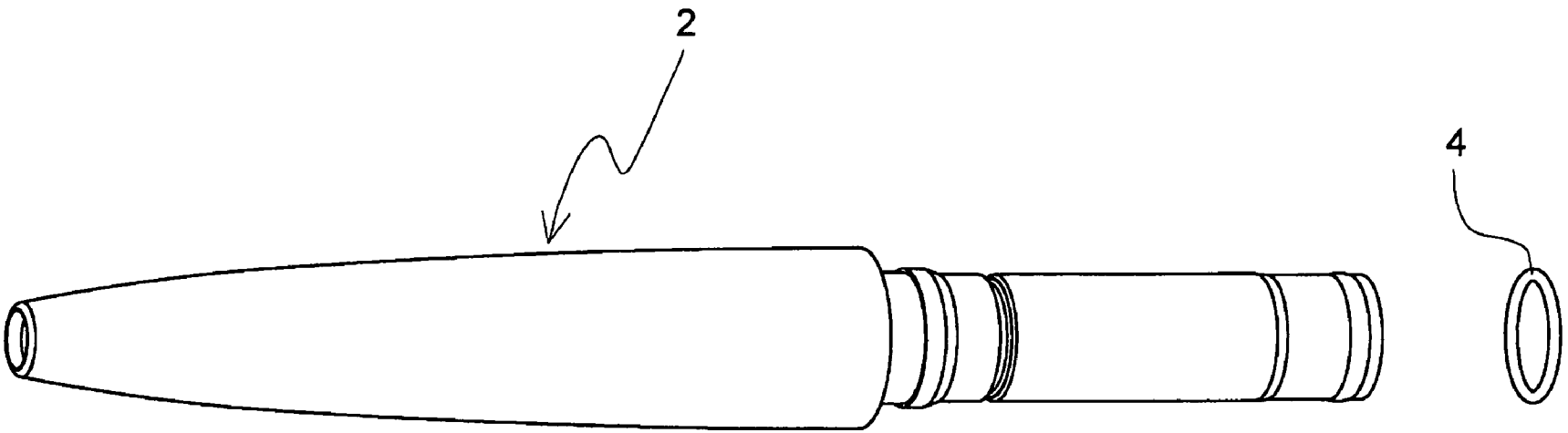
FIG. 7 is a perspective view of the same.

In the present embodiment, as shown in FIG. 1, an O-ring 4 is attached between the sleeve 2 and the main body 3, whereby it is possible to secure a suitable rotational resistance at a time of relatively rotating the sleeve 2 and the main body 3 (refer to FIGS. 6 and 7).

In specific, the main body 3 is structured, as shown in FIGS. 10 to 12, such as to have a female screw 31 connected to the rear portion of the sleeve 2 so as to be rotatable around the axis and engaging with the male screw 12*a* of the screw rod 1, and a chip 32.

It is possible to receive and assemble the screw rod 1 in the inner portion together with the sleeve 2, on the basis of the main body 3. As a result, it is possible to realize the basic structure of the stick-shaped cosmetic material feeding container in which the eyebrow 10 held in the screw rod 1 can be fed by relatively rotating the sleeve 2 and the main body 3.

Next, a description will be particularly given in detail of a part relating to claim 6 in an embodiment in accordance with the present invention with reference to FIGS. 10 to 18.

In this case, in FIGS. 10 to 18, the connecting means 13 is not expressed as a matter of convenience for explanation.

In the stick-shaped cosmetic material feeding container in accordance with the present embodiment, there is provided a constitutional feature that it is possible to securely avoid the matter that the core chuck 11*a* is damaged in the process of executing a work of assembling the screw rod 1 within the sleeve 2. Accordingly, a description will be further in detail given below of the constitutional feature.

In the present embodiment, the structure is made such that the rotation of the screw rod 1 around the axis is not inhibited in the case that the protruding line 14*a* of the rotation prevention 14 exists before the groove 22*a* in the second section 22, at a time of inserting the screw rod 1, the protruding line 11*b* of the core chuck 11*a* exists before the groove 21*a* in the first section 21 in the case that the protruding line 14*a* of the rotation prevention 14 comes to the groove 22*a* in the second section 22, and the protruding line 11*b* of the core chuck 11*a* is fitted to the groove 21*a* in the first section 21 in the case that the protruding line 14*a* of the rotation prevention 14 exists in the middle of the groove 22*a* in the second section 22.

Figure 16:
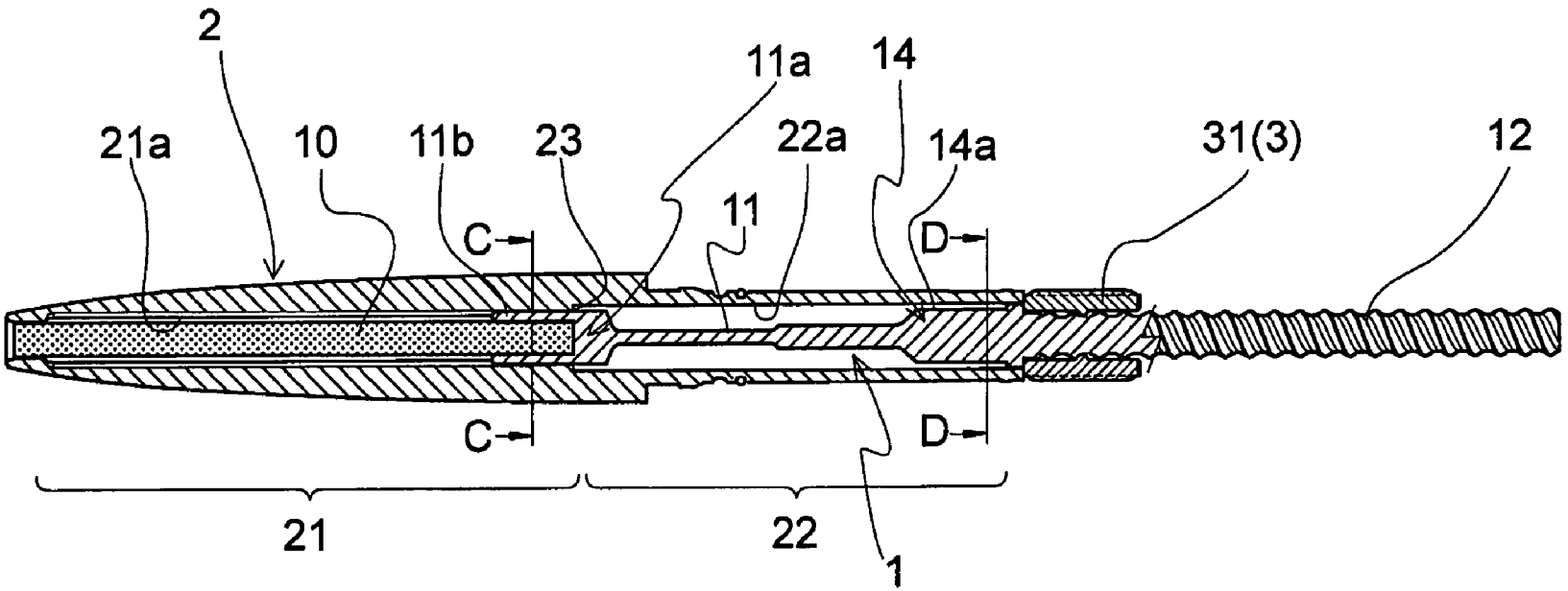
FIG. 16 is a longitudinal sectional view showing a condition of finishing the assembly of the stick-shaped cosmetic material feeding container.
Figure 17:
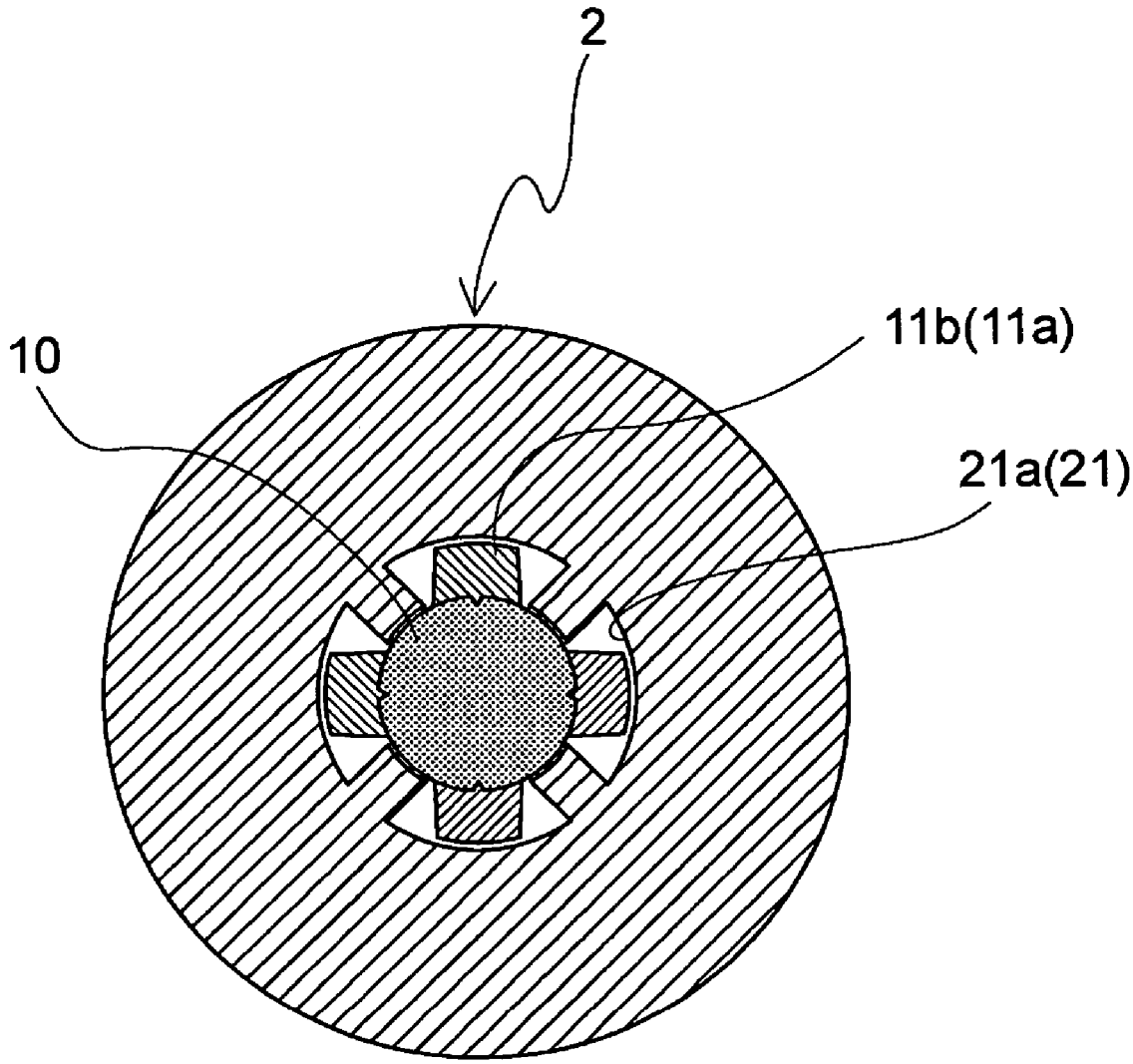
FIG. 17 is a cross sectional view along a line C—C in FIG. 16.
Figure 18:
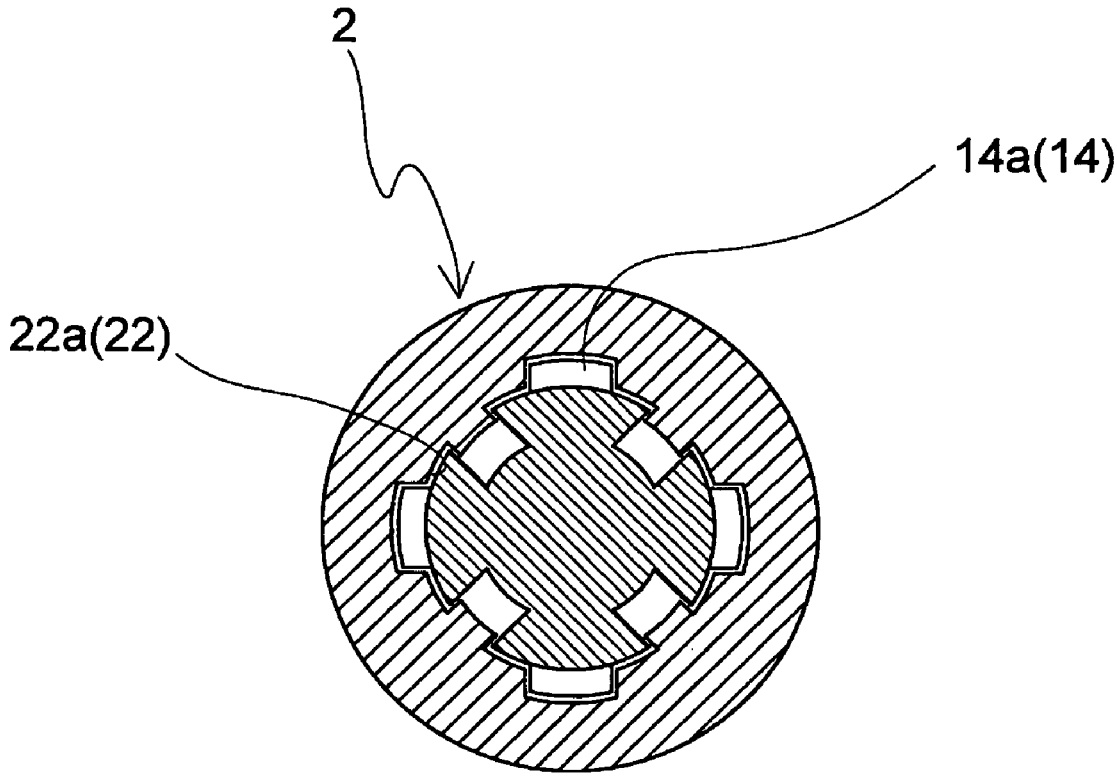
FIG. 18 is a cross sectional view along a line D—D in FIG. 16.

In other words, the screw rod 1 in accordance with the present embodiment is structured such that the screw rod 1 can rotate at approximately 60 degree around the axis (refer to FIG. 13) at a position (refer to FIG. 12) in which the core chuck 11*a* exists within the second section 22 and the rotation prevention 14 exists in the rear side of the second section 22, and can move in the axial direction between a position (refer to FIG. 6) in which the core chuck 11*a* exists within the second section 22 and a position (refer to FIGS. 17 and 18) in which the protruding line 11*b* of the core chuck 11*a* is fitted to the groove 21*a* in the first section 21, in a state in which the protruding line 14*a* of the rotation prevention 14 and the groove 22*a* in the second section 22 are fitted to each other (refer to FIGS. 16 and 18).

The protruding line 14*a* of the rotation prevention 14 can be fitted to the groove 22*a* in the second section 22 at a timing before the protruding line 11*b* of the core chuck 11*a* is fitted to the groove 21*a* in the first section 21 in the process of executing the work of assembling the screw rod 1 within the sleeve 2, and the protruding line 11*b* of the core chuck 11*a* can be guided so as to be fitted to the groove 21*a* in the first section 21 while using the groove 22*a* in the second section 22 as a guide rail, on the basis of the screw rod 1.

In other words, on the basis of the screw rod 1, it is possible to realize the stick-shaped cosmetic material feeding container in which the protruding line 11*b* of the core chuck 11*a* can be easily fitted to the groove 21*a* in the first section 21 existing in the depth side of the second section 22 while preventing the core chuck 11*a* from striking against the step 23 in the boundary.

Figure 13:
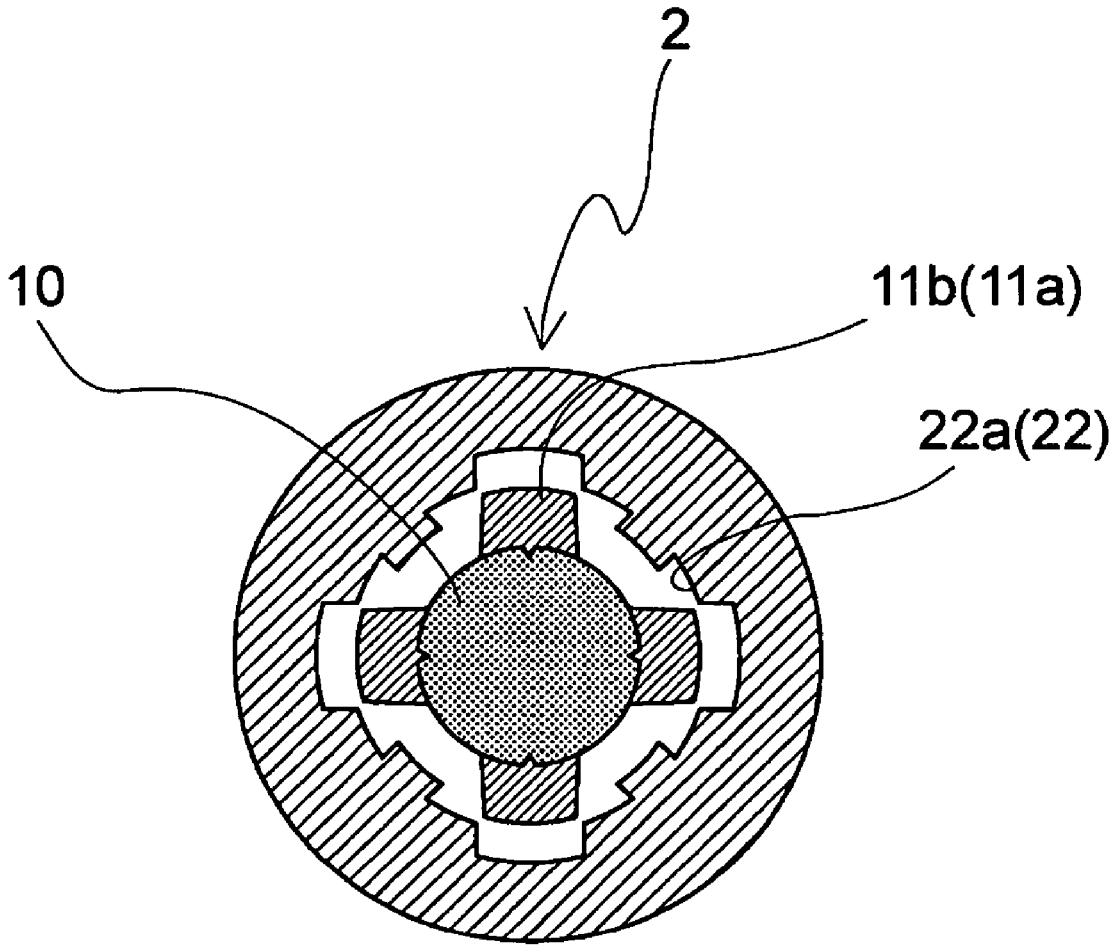
FIG. 13 is a cross sectional view along a line A—A in FIG. 12.
Figure 14:
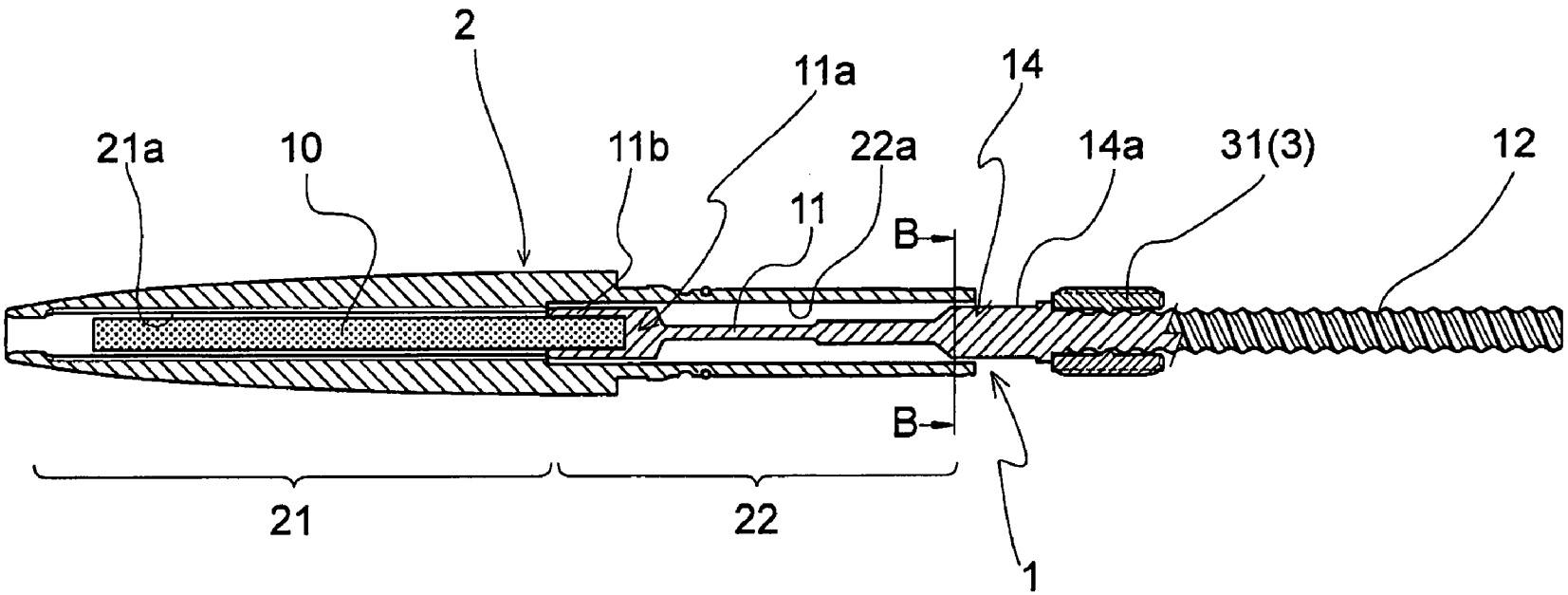
FIG. 14 is a longitudinal sectional view showing a condition in the middle of the assembly of the stick-shaped cosmetic material feeding container.
Figure 15:
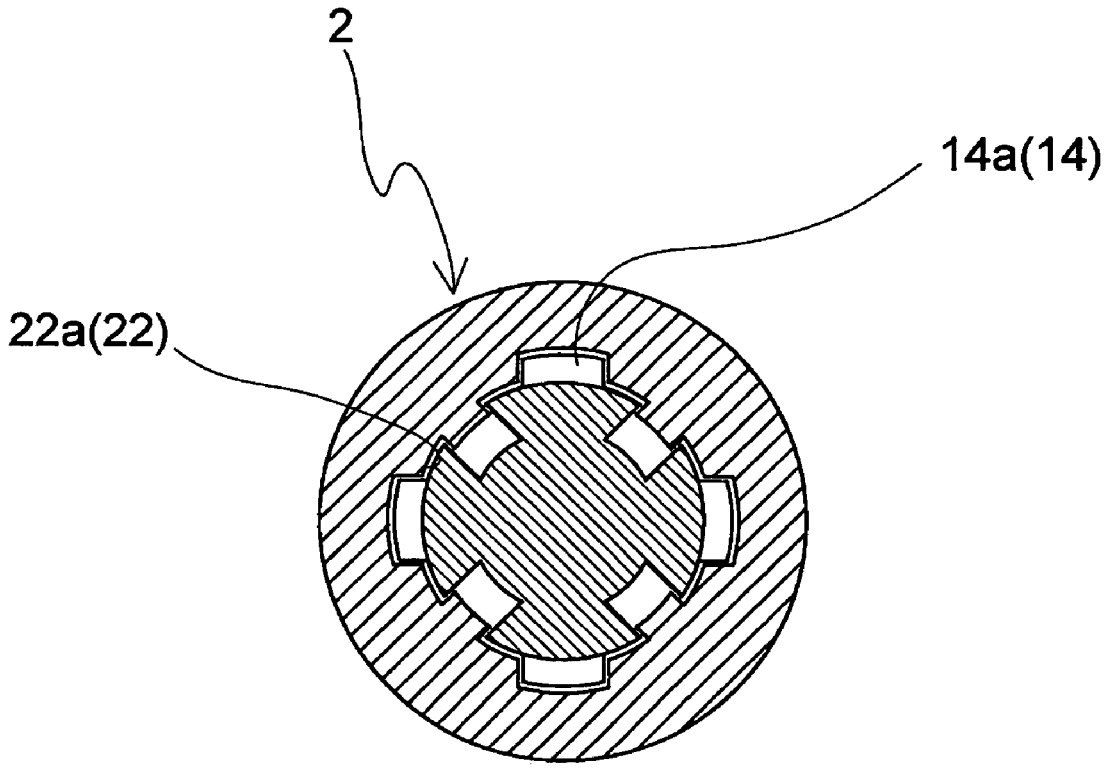
FIG. 15 is a cross sectional view along a line B—B in FIG. 14.

In this case, as shown in FIGS. 13 and 14, the screw rod 11 is required to be rotatable at approximately 60 degree around the axis at the position in which the core chuck 11*a* exists within the second section 22 and the rotation prevention 14 exists in the rear side of the second section 22, for the purpose of securing the basic function of the stick-shaped cosmetic material feeding container that the protruding line 11*b* of the core chuck 11*a* can be easily fitted to the groove 21*a* in the first section 21 while preventing the core chuck 11*a* from striking against the step 23 between the groove 21*a* in the first section 21 and the groove 22*a* in the second section 22, by securely excluding the condition in which the groove 21*a* or the like in the first section 21 constrains the core chuck 11*a*, whereby the screw rod 1 can not rotate and the protruding line 14*a* of the rotation prevention 14 can not be fitted to the groove 22*a* in the second section 22, at a timing before the protruding line 14*a* of the rotation prevention 14 is fitted to the groove 22*a* in the second section 22. Accordingly, as far as same function as above can be achieved, it is possible to employ, for example, a screw rod which can rotate at a necessary angle for easily fitting the protruding line 11*b* of the core chuck 11*a* of a screw rod which can fully rotate around the axis to the groove 21*a* in the first section 21, at a position in which the core chuck 11*a* exists within the second section 22 and the rotation prevention 14 exists in the rear side of the second section 22, in place of the screw rod 1 which can rotate at approximately 60 degree around the axis at the position in which the core chuck 11*a* exists within the second section 22 and the rotation prevention 14 exists in the rear side of the second section 22, in the present invention.

As mentioned above, in the stick-shaped cosmetic material feeding container in accordance with the present embodiment, the structure is made such that the rotation of the screw rod 1 around the axis is not inhibited in the case that the protruding line 14*a* of the rotation prevention 14 exists before the groove 22*a* in the second section 22 at a time of inserting the screw rod 1, the protruding line 11*b* of the core chuck 11*a* exists before the groove 21*a* in the first section 21 in the case that the protruding line 14*a* of the rotation prevention 14 comes to the groove 22*a* in the second section 22, and the protruding line 11*b* of the core chuck 11*a* is fitted to the groove 21*a* in the first section 21 in the case that the protruding line 14*a* of the rotation prevention 14 exists in the middle of the groove 22*a* in the second section 22.

In other words, in accordance with the stick-shaped cosmetic material feeding container mentioned above, the protruding line 14*a* of the rotation prevention 14 can be fitted to the groove 22*a* in the second section 22 at a timing before the protruding line 11*b* of the core chuck 11*a* is fitted to the groove 21*a* in the first section 21 in the process of executing the work of assembling the screw rod 1 within the sleeve 2, and the protruding line 11*b* of the core chuck 11*a* can be guided so as to be fitted to the groove 21*a* in the first section 21 while using the groove 22*a* in the second section 22 as a guide rail.

Therefore, in accordance with the structure mentioned above, it is possible to easily fit the protruding line 11*b* of the core chuck 11*a* to the groove 21*a* in the first section 21 existing in the depth side of the second section 22 while preventing the core chuck 11*a* from striking against the step 23 in the boundary even in the case that the step 23 is formed in the boundary between the groove 21*a* in the first section 21 and the groove 22*a* in the second section 22, whereby it is possible to securely avoid the matter that the core chuck 11*a* is damaged in the process of executing the work of assembling the screw rod 1 within the sleeve 2.

As mentioned above, in the stick-shaped cosmetic material feeding container in accordance with the embodiment of the present invention, the screw rod 1 is structured such that the first rod-like member 11 and the second rod-like member 12 is connected in a state in which the synchronous rotation on the basis of the normal torque and the idle running on the basis of the excessive torque can be achieved.

Therefore, in accordance with the stick-shaped cosmetic material feeding container mentioned above, it is possible to actuate the torque limiter on the basis of the distinct structure which is absolutely different from the conventional technical means obtained by devising the structure of the engaging portion between the screw rod and the sleeve, or the engaging portion between the screw rod and the main body in one way or another, whereby it is possible to prevent the container from being broken.

Therefore, in accordance with the structure mentioned above, it is possible to widen the technical alternative, that is, it is possible to contribute to making the technique plentiful.

As mentioned above, in the present embodiment, the description is given of the case that the eyebrow is used as the stick-shaped cosmetic material, however, the present invention is not limited to the embodiment mentioned above. The present invention can be widely applied, for example, to the case of using an eyeliner, a lip liner, a concealer or the other stick-shaped cosmetic materials.

What is claimed is:

1. A stick-shaped cosmetic material feeding container comprising:

a screw rod in which a core chuck holding a stick-shaped cosmetic material is provided in a leading end, and a male screw is formed in an outer periphery;

a tubular sleeve which has an inner portion supporting said screw rod so as to be non-rotatable and slidable in an axial direction; and a tubular main body which is connected to said sleeve from a rear side so as to be rotatable around an axis, and in which a female screw engaging with the male screw of said screw rod is formed in an inner periphery;

said sleeve and the main body being relatively rotated so as to feed the stick-shaped cosmetic material held in the screw rod, wherein said screw rod is structured by connecting a first rod-like member having a core chuck, corresponding to a front side, and a second rod-like member with the male screw being formed, corresponding to a rear side, via a connecting means allowing a synchronous rotation on the basis of a normal torque and allowing an idle running on the basis of an excessive torque.

2. A stick-shaped cosmetic material feeding container as claimed in claim 1, wherein said connecting means is structured such as to connect by fitting and inserting a shaft portion which is provided in a rear end portion of said first rod-like member or a leading end portion of said second rod-like member and has a protruding line or a groove extending in an axial direction in an outer periphery, into a socket which is provided in the leading end portion of said second rod-like member or the rear end portion of said first rod-like member and has a groove or a protruding line fitted to the protruding line or the groove of said shaft portion in an inner periphery, in such a manner that said protruding line and the groove are fitted to each other.

3. A stick-shaped cosmetic material feeding container as claimed in claim 2, wherein said connecting means is structured such that at least any one of said protruding line and the groove is constituted by an elastic body.

4. A stick-shaped cosmetic material feeding container as claimed in claim 3, wherein said connecting means has a disengagement preventing means for preventing said fitted and inserted shaft portion from being apart from said socket is provided.

5. A stick-shaped cosmetic material feeding container as claimed in claim 4, wherein said screw rod has a rotation prevention supported so as to be non-rotatable and slidable in an axial direction by an inner portion of said sleeve in a rear side of said core chuck.

6. A stick-shaped cosmetic material feeding container as claimed in claim 5, wherein an inner portion of said sleeve is provided with a first section corresponding to a front side along which said core chuck slides, and a second section corresponding to a rear side along which said rotation prevention slides, said core chuck has a protruding portion protruding toward an outer side, a grove supporting the core chuck so as to be slidable in an axial direction by being fitted to the protruding portion is formed within said first section, said rotation prevention has a protruding portion protruding toward an outer side, a groove supporting the rotation prevention so as to be non-rotatable and slidable in an axial direction by being fitted to the protruding portion is formed within said second section, the rotation of the screw rod around the axis is not inhibited at a time when said screw rod is inserted and the protruding portion of said rotation prevention exists before the groove in the second section, the protruding portion of said core chuck exists before the groove in the first section at a time when the protruding portion of the rotation prevention comes to the groove in the second section, and the protruding portion of the core chuck is fitted to the grove in the first section at a time when the protruding portion of the rotation prevention exists in the middle of the groove in the second section, in the case that said sleeve is assembled by inserting said screw rod from the rear side.

7. A stick-shaped cosmetic material feeding container as claimed in claim 3, wherein said screw rod has a rotation prevention supported so as to be non-rotatable and slidable in an axial direction by an inner portion of said sleeve in a rear side of said core chuck.

8. A stick-shaped cosmetic material feeding container as claimed in claim 7, wherein an inner portion of said sleeve is provided with a first section corresponding to a front side along which said core chuck slides, and a second section corresponding to a rear side along which said rotation prevention slides, said core chuck has a protruding portion protruding toward an outer side, a grove supporting the core chuck so as to be slidable in an axial direction by being fitted to the protruding portion is formed within said first section, said rotation prevention has a protruding portion protruding toward an outer side, a groove supporting the rotation prevention so as to be non-rotatable and slidable in an axial direction by being fitted to the protruding portion is formed within said second section, the rotation of the screw rod around the axis is not inhibited at a time when said screw rod is inserted and the protruding portion of said rotation prevention exists before the groove in the second section, the protruding portion of said core chuck exists before the groove in the first section at a time when the protruding portion of the rotation prevention comes to the groove in the second section, and the protruding portion of the core chuck is fitted to the grove in the first section at a time when the protruding portion of the rotation prevention exists in the middle of the groove in the second section, in the case that said sleeve is assembled by inserting said screw rod from the rear side.

9. A stick-shaped cosmetic material feeding container as claimed in claim 2, wherein said connecting means has a disengagement preventing means for preventing said fitted and inserted shaft portion from being apart from said socket is provided.

10. A stick-shaped cosmetic material feeding container as claimed in claim 9, wherein said screw rod has a rotation prevention supported so as to be non-rotatable and slidable in an axial direction by an inner portion of said sleeve in a rear side of said core chuck.

11. A stick-shaped cosmetic material feeding container as claimed in claim 10, wherein an inner portion of said sleeve is provided with a first section corresponding to a front side along which said core chuck slides, and a second section corresponding to a rear side along which said rotation prevention slides, said core chuck has a protruding portion protruding toward an outer side, a grove supporting the core chuck so as to be slidable in an axial direction by being fitted to the protruding portion is formed within said first section, said rotation prevention has a protruding portion protruding toward an outer side, a groove supporting the rotation prevention so as to be non-rotatable and slidable in an axial direction by being fitted to the protruding portion is formed within said second section, the rotation of the screw rod around the axis is not inhibited at a time when said screw rod is inserted and the protruding portion of said rotation prevention exists before the groove in the second section, the protruding portion of said core chuck exists before the groove in the first section at a time when the protruding portion of the rotation prevention comes to the groove in the second section, and the protruding portion of the core chuck is fitted to the grove in the first section at a time when the protruding portion of the rotation prevention exists in the middle of the groove in the second section, in the case that said sleeve is assembled by inserting said screw rod from the rear side.

12. A stick-shaped cosmetic material feeding container as claimed in claim 2, wherein said screw rod has a rotation prevention supported so as to be non-rotatable and slidable in an axial direction by an inner portion of said sleeve in a rear side of said core chuck.

13. A stick-shaped cosmetic material feeding container as claimed in claim 12, wherein an inner portion of said sleeve is provided with a first section corresponding to a front side along which said core chuck slides, and a second section corresponding to a rear side along which said rotation prevention slides, said core chuck has a protruding portion protruding toward an outer side, a grove supporting the core chuck so as to be slidable in an axial direction by being fitted to the protruding portion is formed within said first section, said rotation prevention has a protruding portion protruding toward an outer side, a groove supporting the rotation prevention so as to be non-rotatable and slidable in an axial direction by being fitted to the protruding portion is formed within said second section, the rotation of the screw rod around the axis is not inhibited at a time when said screw rod is inserted and the protruding portion of said rotation prevention exists before the groove in the second section, the protruding portion of said core chuck exists before the groove in the first section at a time when the protruding portion of the rotation prevention comes to the groove in the second section, and the protruding portion of the core chuck is fitted to the grove in the first section at a time when the protruding portion of the rotation prevention exists in the middle of the groove in the second section, in the case that said sleeve is assembled by inserting said screw rod from the rear side.

14. A stick-shaped cosmetic material feeding container as claimed in claim 1, wherein said screw rod has a rotation prevention supported so as to be non-rotatable and slidable in an axial direction by an inner portion of said sleeve in a rear side of said core chuck.

15. A stick-shaped cosmetic material feeding container as claimed in claim 14, wherein an inner portion of said sleeve is provided with a first section corresponding to a front side along which said core chuck slides, and a second section corresponding to a rear side along which said rotation prevention slides, said core chuck has a protruding portion protruding toward an outer side, a grove supporting the core chuck so as to be slidable in an axial direction by being fitted to the protruding portion is formed within said first section, said rotation prevention has a protruding portion protruding toward an outer side, a groove supporting the rotation prevention so as to be non-rotatable and slidable in an axial direction by being fitted to the protruding portion is formed within said second section, the rotation of the screw rod around the axis is not inhibited at a time when said screw rod is inserted and the protruding portion of said rotation prevention exists before the groove in the second section, the protruding portion of said core chuck exists before the groove in the first section at a time when the protruding portion of the rotation prevention comes to the groove in the second section, and the protruding portion of the core chuck is fitted to the grove in the first section at a time when the protruding portion of the rotation prevention exists in the middle of the groove in the second section, in the case that said sleeve is assembled by inserting said screw rod from the rear side.

* * * * *